United States Patent [19]

Schippers et al.

[11] Patent Number: 4,505,437

[45] Date of Patent: Mar. 19, 1985

[54] APPARATUS FOR WINDING A PLURALITY OF YARNS

[75] Inventors: Heinz Schippers; Erich Lenk; Herbert Turk; Herbert Schiminski, all of Remscheid, Fed. Rep. of Germany

[73] Assignee: Barmag Barmer Maschinenfabrik AG, Remscheid, Fed. Rep. of Germany

[21] Appl. No.: 571,508

[22] Filed: Jan. 17, 1984

[30] Foreign Application Priority Data

| | | | |
|---|---|---|---|
| Jan. 29, 1983 | [DE] | Fed. Rep. of Germany | 3302962 |
| Mar. 24, 1983 | [DE] | Fed. Rep. of Germany | 3310620 |
| Aug. 11, 1983 | [DE] | Fed. Rep. of Germany | 3328968 |

[51] Int. Cl.[3] ..... B65H 54/28

[52] U.S. Cl. ..... 242/43 A

[58] Field of Search ..... 242/43 A, 43 R

[56] References Cited

U.S. PATENT DOCUMENTS

| | | | |
|---|---|---|---|
| 3,362,652 | 1/1968 | Butterworth | 242/43 A |
| 3,374,961 | 3/1968 | Otsuka et al. | 242/43 A |
| 3,650,486 | 3/1972 | Hasegawa et al. | 242/43 A |

FOREIGN PATENT DOCUMENTS

| | | | |
|---|---|---|---|
| 396207 | 5/1924 | Fed. Rep. of Germany | 242/43 A |
| 396776 | 6/1924 | Fed. Rep. of Germany | 242/43 A |
| 679838 | 8/1939 | Fed. Rep. of Germany | 242/43 A |
| 690941 | 5/1940 | Fed. Rep. of Germany | 242/43 A |
| 1710068 | 10/1971 | Fed. Rep. of Germany | 242/43 A |
| 3001953 | 8/1980 | Fed. Rep. of Germany | 242/43 A |
| 29054 | of 1911 | United Kingdom | 242/43 A |
| 1168893 | 10/1969 | United Kingdom | 242/43 A |

*Primary Examiner*—Stanley N. Gilreath

*Attorney, Agent, or Firm*—Bell, Seltzer, Park & Gibson

[57] ABSTRACT

A yarn winding apparatus is disclosed which is characterized by the ability to wind a plurality of running yarns onto a corresponding number of bobbins mounted on a common support spindle, and wherein the bobbins may be closely spaced apart to thereby permit the required length of the support spindle to be minimized. The apparatus comprises a plurality of side by side traversing assemblies extending along the length of the bobbin support spindle, with each traversing assembly comprising a yarn guide bar and a pair of oppositely rotating rotors. The rotors are each composed of two oppositely directed radial arms, which define two closely adjacent planes of rotation. The two rotors of each assembly are mounted for rotation about off-set axes, and such that the arms sweep across the guide bar in opposite directions to define the traverse stroke. Also, the two axes of all of the traversing assemblies are offset in the same direction, with the corresponding axes of all of the adjacent traversing assemblies being equally spaced apart a predetermined distance, and such that the extremities of the arms of adjacent traversing assemblies define circles upon rotation thereof which overlap in both of the planes of rotation.

22 Claims, 11 Drawing Figures

APPARATUS FOR WINDING A PLURALITY OF YARNS

The present invention relates to a yarn winding apparatus for winding a plurality of running yarns to form a corresponding number of yarn packages. The winding apparatus is particularly adapted for winding continuously running yarns, such as synthetic yarns which are continuously delivered and wound into packages at speeds exceeding 6000 m/minute.

A yarn winding apparatus is disclosed in German Pat. No. 15 60 469 and corresponding British Pat. No. 1,168,893 which comprises two yarn guide blades which are mounted for rotation in opposite directions about parallel offset axes, with the axes being positioned so that the ends of the blades alternately sweep over a yarn guide bar in opposite directions to reciprocate the yarn along a traverse stroke, and so as to form a cross-wound package.

It is an object of the present invention to provide a winding apparatus of the above general type, and which is suited for simultaneously winding a plurality of yarns, and more particularly, for winding a plurality of yarns which are delivered along parallel paths of travel to a plurality of closely spaced apart winding stations.

It is a more particular object of the present invention to provide a yarn winding apparatus which has the ability to wind a plurality of running yarns onto a corresponding number of carrier tubes, commonly termed bobbins, which are mounted on a common support spindle, and wherein the bobbins may be closely spaced apart on the support spindle to thereby permit the required length of the support spindle to be minimized.

These and other objects and advantages of the present invention are achieved in the embodiments illustrated herein by the provision of a winding apparatus which comprises bobbin support means for mounting a plurality of tubular bobbins in a coaxial, closely spaced apart arrangement, and a plurality of traversing assemblies disposed in a closely spaced apart arrangement extending along the bobbin support means. Each of the traversing assemblies comprises a yarn guide bar mounted to extend in a direction generally parallel to the axis of the bobbin support means, a first rotor having two oppositely directed radial arms and mounted for rotation about a first axis, and a second rotor having two oppositely directed radial arms and mounted for rotation about a second axis, with the two axes being parallel to and offset from each other in a direction generally parallel to the axis of the bobbin support means. Also, the two rotors are positioned so that the arms thereof define respective first and second planes which are parallel to and closely adjacent to each other, and the axes of the rotors are positioned such that the extremities of the arms pass along the yarn guide bar upon rotation thereof.

In accordance with the present invention, the traversing assemblies are mounted adjacent to each other such that each traversing assembly has its first axis offset from its second axis in the same direction, and with the corresponding axes of all of the adjacent traversing assemblies being equally spaced apart a distance which is less than twice the radial length of the arms and greater than the radial length of the arms times the square root of two. Further, the first and second planes of the assemblies are respectively coincident, and in addition, the extremities of the arms of adjacent traversing assemblies define circles upon rotation thereof which overlap in both of the first and second planes. The winding apparatus further includes drive means for rotating the rotors of each traversing assembly in opposite directions with respect to each other, and for rotating the rotors of adjacent traversing assemblies such that the first rotors thereof rotate in the same direction with respect to each other and the second rotors thereof rotate in the same direction with respect to each other.

In the preferred embodiment, each of the traversing assemblies further comprises a guide roll mounted for rotation about an axis parallel to the bobbin support means, and at a location between the guide bar and the bobbin support means, and such that the running yarn is adapted to partially loop about the guide roll prior to being wound onto a bobbin.

The above described winding apparatus permits the traverse strokes to be arranged in a parallel and closely spaced arrangement, and so that the bobbins may be mounted on a common mounting spindle with the ends of the bobbins abutting each other, or lying so close to each other that there remains only a space needed for the formation of a waste winding and a transfer tail. By reason of the fact that all of the arms of the rotors are arranged in only two planes of rotation, the distance between the arms is as small as possible, and the distance between the planes of rotation of the arms and the point at which the yarn runs onto the underlying guide roll is also small. Further, where all of the guide rolls are arranged along a common axis, a uniform yarn run through all of the winding stations is ensured, so that uniform packages are produced. The coaxial arrangement of the guide rolls closely below the lower plane of rotation of the rotors offers the further possibility of positioning and mounting the bobbins at will, as long as it is ensured that the line along which the yarn runs onto the bobbin extends parallel to, and either at a small distance or in circumferential contact with, the guide roll. Under these conditions, it is possible to produce cylindrical or conical bobbins, or bobbins having different winding periods with respect to the beginning, duration or end of the winding cycle.

The extremities of the arms are preferably provided with a trailing edge, sometimes termed a "braking flag", which is positioned on the side of the arm which is opposite the edge which contacts the yarn. This braking flag is configured such that the point where the arm covers the guide bar moves toward the center of the traverse stroke at essentially the traversing speed. Stated in other words, the trailing edge cooperates with the guide bar in engaging the yarn after the yarn has reached the end of the traverse stroke and so as to permit the yarn to move along the trailing edge and guide bar from the end of the traverse stroke toward the center thereof at a controlled speed. The possibility that the yarn may move toward the center of the traverse stroke at a higher speed than provided by the speed of the leading edge, is thereby avoided.

At the beginning and the end of the winding process, the yarn should be removed from the traversing assembly. For this purpose, the guide bar may be arranged on the side of the yarn running plane on which the drive means for driving the rotors is also located. Further, the guide bar may be withdrawn from the rotor axes until the guide bar is no longer covered by the arms. This embodiment offers the advantageous possibility of providing the guide bar with a yarn catching notch which is positioned at each end portion of the guide bar at a location beyond the traverse stroke. When the guide bar is withdrawn from the area where it is covered by the rotors, the yarn slides into the yarn guiding notch.

The guide bar of the present invention may also serve as a yarn guiding member which, for example, may carry the running yarn into a yarn catching zone and/or a yarn zone for winding a transfer tail. By shaping the contour of the guide bar, the advantageous possibility is provided of achieving certain stroke patterns for the yarn, such as causing the traversing speed of the yarn to be reduced in the center of the stroke so that an accumulation of yarn windings at the center may be achieved which is for example 2% greater than the yarn windings accumulated in the end portions of the traverse stroke.

Where the guide bar is positioned on the side of the yarn path where the drive means for the rotors is also located, it is possible to protect the arms on the yarn handling side of the yarn path by a protective cover plate. Such plate may extend in the yarn running direction beyond the planes of rotation, and the plate may be fixed at one end of the traverse stroke and extend parallel to the stroke. At the other end of the traverse stroke, the plate may include a yarn inserting slot directed into the plane of the yarn run. By this arrangement, it is ensured that injuries to personnel caused by the rotating arms may be avoided, and also that the arms cannot be damaged during handling of the yarn, such as by a suction pistol which is used to guide the yarn during thread-up. The yarn inserting slot preferably cooperates with a generally known arrangement for forming a yarn zone for winding a transfer tail, by which the yarn is caught and carried into the area of the traverse stroke, where it is released so that it may be caught by the rotating arms.

It is also proposed that the guide bar may serve as a guide means at least in special areas. For this purpose, the guide bar may be composed of an inner and an outer guide rail, so that the yarn cannot be removed from the guide bar. It is particularly advantageous to arrange these rails at the ends of the traverse stroke, if the yarn is to be reciprocated according to a reciprocation pattern with increased accelerations and/or decelerations.

It is also possible that the two edges of each guide rail are contoured in a different manner, and that the edges of the arms be designed such that the edges control the yarn along one guide rail when moving forward and along the other guide rail when moving backward.

As noted above, the so-called yarn trailing length between the operative edges of the arms and the point where the yarn contacts the bobbin, should be small. This trailing length may be considerably shortened by positioning the yarn guide roll between the planes of rotation of the arms and the bobbin, with the roll being covered without being contacted by the leading edges of the arms sweeping thereacross. The diameter of the guide roll is relatively small, so that the point where the yarn contacts the guide roll is located very closely below the lower plane of rotation. This distance may essentially equal the radius of the guide roll. Another preferred possibility for reducing the yarn trailing length includes inclining the traversing assemblies in such a manner that the planes of rotation of the arms and the planes of the yarn run form an angle which ranges between about 45 degrees and 70 degrees. The yarn trailing length between the rotating planes of the arms and the point where the yarn contacts the guide roll may thus be shortened such that it is less than the radius of the guide roll.

Where the drive means for rotating the rotors is mounted on the side of the planes of rotation which is opposite from the bobbins, additional space is provided for arranging drive rolls between the planes of rotation and the bobbins. Such drive rolls preferably are driven at a constant speed, and contact the bobbins along a straight line which runs along the circumference of the bobbins and the circumference of the associated drive rolls.

Preferably, the yarn moves from the guide roll to the bobbin substantially without forming a trailing length. In order to avoid any trailing length between the guide roll and the bobbin, the guide roll may be arranged so as to contact the circumference of the bobbin. To this effect, the guide roll is preferably supported by a spring biasing arrangement which permits the guide roll to follow the contour of the rotating package in the event the surface is noncircular. A drive roll may also be provided which is suspended by the same spring biasing arrangement. It is thereby provided that both the guide roll and the drive roll withdraw from the axis of the bobbin support spindle during the build of the package. Further, the drive roll may also serve to provide for an increase in the distance between the support spindle axis and the traversing apparatus, while the package builds. For this purpose, the drive roll, the guide roll, and the traversing assembly may be mounted on a common carriage, with the guide roll being movable with respect to the carriage by means of springs, and the drive means of the carriage being controlled as a function of the deflection of the guide roll caused by the build of the package.

In those embodiments where the gears as well as the other portions of the drive means for the rotors are positioned on the side of the planes of rotation adjacent the support spindle, it is easy to maintain the traversing device, and in particular to remove windings. Also, in such cases it is not necessary that the gears of the rotors be dismounted if the rotors need to be removed.

In those embodiments where the gears and related drive means of the rotors are positioned on one side of the planes of rotation, one rotor may include a first rotatably mounted shaft, and the other rotor may include a tubular second shaft which receives the first shaft eccentrically therethrough. The two second shafts may be driven by separate drives, for example, by belts or gear wheels. In view of the fact that it is important that the rotational speeds of the rotors be controlled very precisely with respect to each other, so that an exact transfer of the yarn from one to the other arm may be ensured, it is preferred that the first and second shafts be drivingly connected to each other by a transmission shaft mounted inside of the tubular second shaft. This permits the tubular second shaft and the first shaft to rotate at precisely the same speed, but in opposite directions and with a precise phase relationship.

The above embodiment also offers the advantageous possibility of providing a casing for each traversing assembly, which houses and supports the shafts of the two rotors. Each casing is designed so that it may be removed and reinstalled for maintenance purposes, independently of the casings of the other traversing assemblies. Also, the phase relationship of the rotors with respect to each other may be precisely adjusted during final assembly at the manufacturing plant. Further, in such instance, only one of the shafts, and preferably the tubular shaft, is driven from the outside, for example by a drive belt, a gear wheel, a worm gear drive, or the like.

Another advantageous driving means for the rotors of the several traversing assemblies includes a pair of drive rods extending along the assemblies in a direction parallel to the bobbin support spindle. One rod drives the rotors of one plane of rotation, and the other rod drives the rotors of the other plane of rotation. In one embodiment, a worm drive is associated with the individual rotors, with the thread direction of the worms on each rod having the same thread direction.

In still another embodiment, the rotors of one plane of rotation may each be driven by a tangential belt, and in a still further embodiment the rotors of one plane of rotation may be driven through bevel gears by a common drive rod extending along the traversing assemblies.

With respect to the above described driving possibilities, the rotors rotating in the second plane of rotation may be driven by a corresponding driving unit. However, these other rotors may also be driven by their associated rotors via intermediate gear wheels, in such a way that the rotors of the traversing assembly rotate at the same speed, but in opposite directions, with the proper phase relationship being ensured for a precise transfer of the yarn at the ends of the traverse stroke.

In another specific embodiment of the invention, the gear drive for the rotors having arms which rotate in the upper plane of rotation, viewed in the direction of the yarn run, are positioned above such plane, and the gear drive for the rotors having arms which rotate in the lower plane of rotation are positioned below such lower plane. In this instance, the housing for the drives is preferably divided into two housing components, so that the upper housing component may be removed, or swung away, from the lower housing component. Removal of the arms and other components is thus facilitated.

Some of the objects and advantages of the invention having been stated, others will appear as the description proceeds, when taken in connection with the accompanying generally schematic drawings in which FIG. 1 is a fragmentary top plan view of three traversing assemblies of a winding apparatus embodying the present invention, and illustrating the rotors and guide bar of each assembly;

Figure 1:
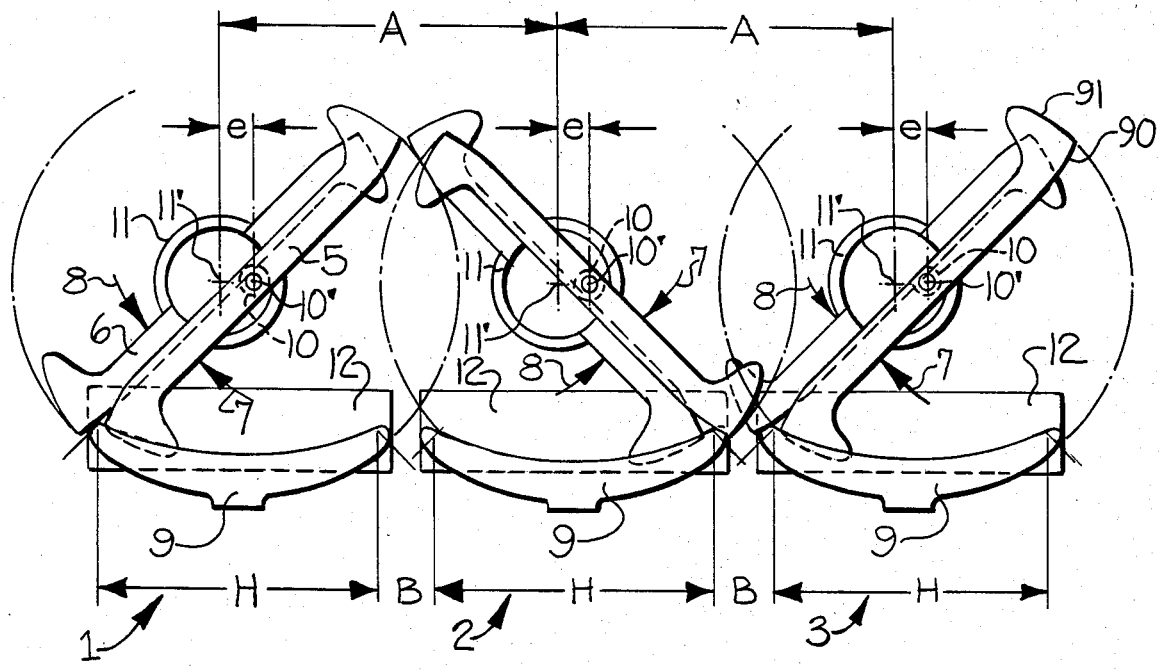
FIG. 1A is a front elevation view of the three traversing assemblies of FIG. 1.
Figure 1A:
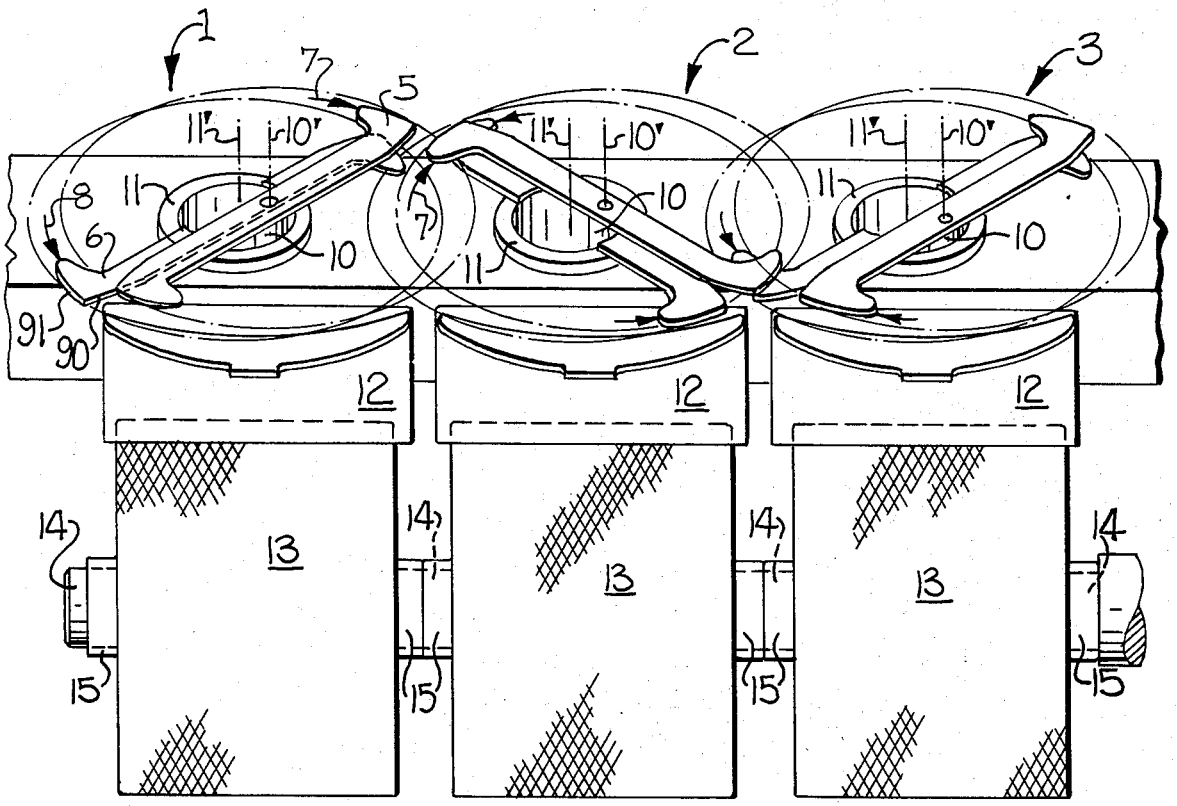
Figure 2:
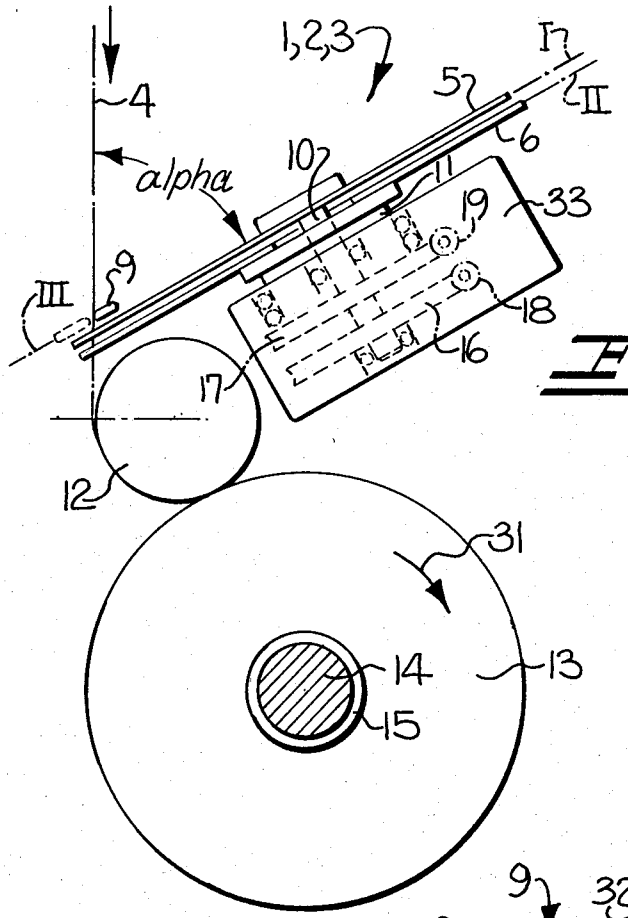
FIG. 2 is a sectional end view of the winding apparatus of FIG. 1.

Referring more particularly to the drawings, FIGS. 1, 1A, and 2 illustrate a winding apparatus embodying the features of the present invention, and which is adapted for winding a plurality of running yarns 4 to form a corresponding number of yarn packages 13. The apparatus comprises a support spindle 14 for mounting a plurality of tubular bobbins 15 in a coaxial arrangement, and yarn traverse means for reciprocating the running yarns 4 along respective aligned traverse strokes and so as to form a wound yarn package 13 on each bobbin 15. As shown in these figures, the yarn traverse means comprises three traversing assemblies 1, 2, and 3 which are disposed in a closely spaced apart arrangement extending along the bobbin support spindle 14, with each traversing assembly being adapted to reciprocate one running yarn 4 onto a rotating bobbin 15 mounted on the support spindle. The bobbin support spindle 14 is driven in the rotational direction 31 by a motor (not shown) which is operatively connected to the spindle.

Each traversing assembly 1, 2, and 3 comprises a yarn guide bar 9 mounted to extend in a direction generally parallel to the axis of the support spindle 14. Further, each assembly comprises a pair of rotors 5, 6. The rotor 5 has two oppositely directed radial arms of equal length, and is connected to a mounting shaft 10 which is mounted in the housing 33 (FIG. 2) for rotation about the axis 10', and such that the extremities of the rotating arms pass along the yarn guide bar 9 and define a first plane I. The second rotor 6 also has two oppositely directed radial arms of equal length, and the rotor 6 includes a tubular mounting shaft 11 which is mounted in the housing 33 for rotation about the axis 11' and such that the extremities of these arms also pass along the yarn guide bar 9 and define a second plane II. The overall length of the rotors 5 and 6 are seen to be substantially equal, with the length of the arms being substantially equal. The first axis 10' is parallel to and offset from the second axis 11' in a direction generally parallel to the axis of the support spindle 14, and the first and second planes I and II are parallel to and closely adjacent each other.

According to the present invention, each traversing assembly 1, 2, and 3 has its axis 10' offset from its axis 11' by the distance e, and with the direction of offset being the same in all of the assemblies. Also, the corresponding axes of all of the adjacent traversing assemblies are equally spaced apart a distance A, and the first and second planes of the three assemblies are respectively coincident, in that all of the rotors 5 rotate in the same plane I, and all of the rotors 6 rotate in the same plane II. Further, the assemblies are mounted such that the extremities of the arms of the rotors of adjacent traversing assemblies define circles upon rotation thereof which overlap in both of the first and second planes.

Each of the traversing assemblies further comprises a guide roll 12 mounted for rotation about an axis parallel to the bobbin support spindle 14, and at a location between the guide bar 9 and the bobbin support spindle. In addition, the guide rolls of all of the traversing assemblies are arranged coaxially, and each is positioned such that the yarn leaving the traversing assembly partially loops about the guide roll prior to being wound onto the bobbin.

As best seen in FIG. 1, all of the rotors 5 rotate in the rotating direction 7 about the axis 10', and the rotors 6 rotate in the opposite direction 8 about the axis 11'. Accordingly, it will be seen that the rotors of all traversing assemblies which are arranged in one plane of rotation rotate in the same direction. Further, as noted above, the axes of the rotors 5 and 6 of each traversing assembly are positioned eccentrically with respect to each other, and the axial distance A between the axes 10' of the three illustrated traversing assemblies is the same. The same is true with respect to the axial distance between the axes 11' of the three assemblies.

As also noted above, the circles of rotation of the rotors 5 or 6 of adjacent traversing assemblies, which rotate in the same plane of rotation I or II, overlap each other, as best seen in FIG. 1. In this regard, the axial distance A between the corresponding axes is chosen so as to be less than twice the radial length of the arms and greater than the radial length of the arms times the square root of two (length $x\sqrt{2}$, so that the distance B between the traverse strokes H is very small. By this dimensioning, it is possible to form a number of closely spaced apart packages 13, which are preferably mounted on a common winding spindle as shown, and which are associated with a corresponding number of aligned traversing assemblies 1, 2, and 3.

In the embodiment of FIGS. 1, 1A, and 2, the guide bar 9 is positioned above the planes I and II in the parallel plane III, and on the same side of the running yarn plane as are the shafts 10 and 11. It should be noted however that the guide bar 9 may alternatively be positioned on the other side of the running yarn plane, as indicated in dashed lines in FIG. 2. It is also possible to utilize a guide bar which includes a guide rail on each side of the yarn, and as further described below with regard to FIG. 4.

Figure 3:
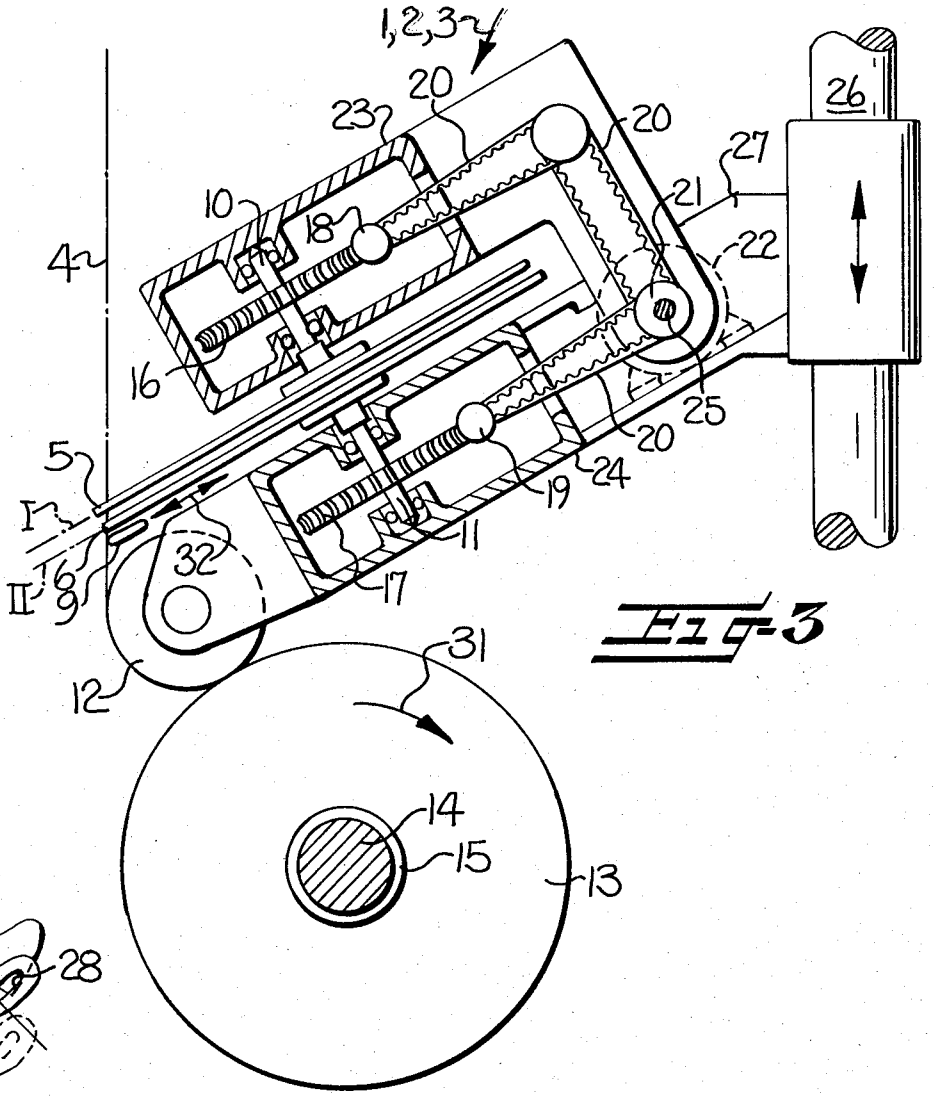
FIG. 3 is a view similar to FIG. 2, but illustrating a further embodiment of the invention.

The traversing assemblies as illustrated in FIGS. 2 and 3 may be mounted on a carriage 27, which in turn is movably mounted on a support rod 26 as shown in FIG. 3. This arrangement permits the traversing assembly to withdraw upwardly as the packages build in diameter. To this effect, appropriate drive and control means as disclosed for example in German Pat. No. 25 32 165 and U.S. Pat. No. 4,106,710, may be provided for controlling the movement of the carriage.

In the embodiment of FIGS. 1, 1A, and 2, the shafts 10 and 11 of the two rotors are positioned, when viewed in the yarn running direction, below the lower plane of rotation II, and thus at a location between the lower plane II and the support spindle. This positioning offers the advantage that the rotors, which may be covered only by a protective cover plate, can be readily cleaned and maintained, and in particular cleaned by removal of windings and yarn fragments. As schematically illustrated, the rotors are rotated by means of a worm gear arrangement which includes a worm gear wheel 16 fixed to the shaft 10, and a worm gear wheel 17 fixed to the tubular shaft 11. The gear wheels 16 and 17 are operatively engaged by the worms 18 and 19 respectively, with the worms 18 and 19 being connected to two drive rods which extend along the length of all of the traversing assemblies. The drive rods are in turn connected to a suitable driving motor (not shown).

In the embodiment of FIG. 3, the rotors 5 and 6 are supported by the shafts 10 and 11 respectively, which extend in opposite directions and thus lie on opposite sides of the planes of rotation I and II. The shafts 10 and 11 mount respective worm gear wheels 16 and 17, and the gear wheels are drivingly connected to each other by a toothed belt drive 20, which in turn is driven by a pulley 21 and drive motor 22. The shafts 10 and 11 are rotatably mounted in housing components 23 and 24, which are connected to each other along the axis of the shaft 25 by a hinge which is disposed coaxially with respect to the shaft 25, pulley 21 and drive motor 22. Thus the housing component 23 may be lifted away from the component 24, rendering the rotors 5 and 6 accessible, to thereby facilitate maintenance of the rotors, and in particular removal of windings and yarn fragments.

Figure 4:
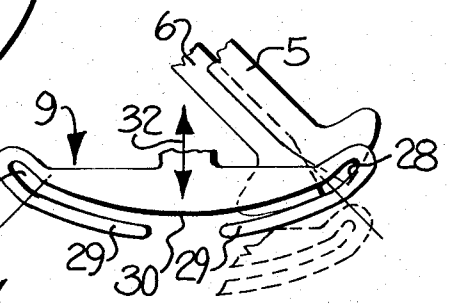
FIG. 4 is a fragmentary plan view of one embodiment of the guide bar adapted for use with the present invention.

FIG. 4 shows an embodiment of a yarn guide bar 9, which may be used in the embodiment of FIG. 3. In particular, the guide bar is composed of a continuous inner guide rail 30 and an outer guide rail 29 extending generally parallel to and spaced from the inner guide rail along each end portion thereof to define a yarn catching notch 28 therebetween. The outer guide rails 29 extend only over the end portions of the traverse stroke, and within such regions, the yarn is retained, which is particularly advantageous if the yarn is to be subjected to special movements, for example, accelerations or decelerations. In addition, the guide bar 9 can be moved in the direction of arrow 32 in FIGS. 3 and 4 such that the inner guide rail 30 is withdrawn from the circle of rotation of the rotors 5 and 6, and as shown in phantom lines in FIG. 4. In the withdrawn position, the yarn is no longer reciprocated, and it slides into one of the yarn catching notches 28 which are arranged at the ends of the traverse stroke, so that it may be caught or drawn off. For inserting the yarn, it is also possible to move the yarn into the yarn catching notches and then move the guide bar in such a manner that the yarn is caught on the bobbin and/or winds the yarn into a yarn zone for winding a transfer tail. When moving the guide bar back, the traversing device is again set into operation, as the yarn catching notches 28 lie within the circles of rotation of the rotors 5 and 6.

Figure 5:
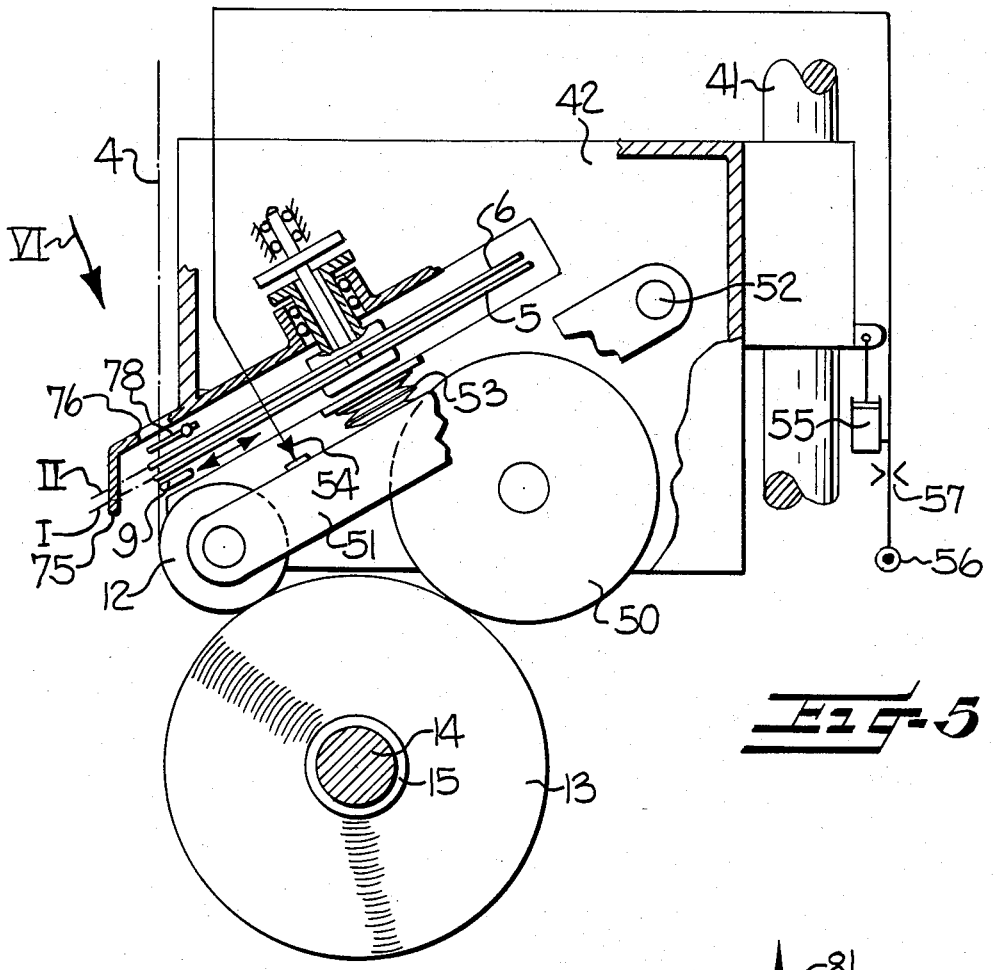
FIG. 5 is a view similar to FIG. 2, but illustrating still another embodiment of the invention.

In the embodiment of FIG. 5, the traversing assemblies are mounted on a carriage 42 which is slideably mounted on the support bar 41 so that the carriage may be moved relative to the packages 13. In addition, the carriage 42 mounts the guide rolls 12 which are mounted on pivot arms 51. The arms 51 are adapted to pivot about the axis of the pin 52, and each is held in position by a spring biasing member, which may for example comprise a set of disc springs 53 which are held under pressure. The guide rolls 12 are thus biased into contact with the packages by the springs 53.

The position of the pivot arm 51 relative to the carriage 42 may be monitored, for example, by a nozzle and deflecting plate system 54. This system produces an output signal which is delivered to the drive means of the carriage 42, with the drive means being schematically illustrated by the cylinder and piston unit 55. The cylinder and piston unit 55 receives a pressure from a pressure source 56 via throttle 57, and the pressure prevailing behind the throttle 57 thus depends on the gap width at the nozzle 54.

The guide roll 12 of the embodiments of FIGS. 2 and 3 may also serve as a drive roll, or as a control roll. Where the guide roll is used as a control roll, its speed is continuously monitored, and the monitored value is transmitted to a drive motor which directly drives the support spindle, so that the circumferential speed of the package remains constant while its diameter is increasing.

Figure 6:
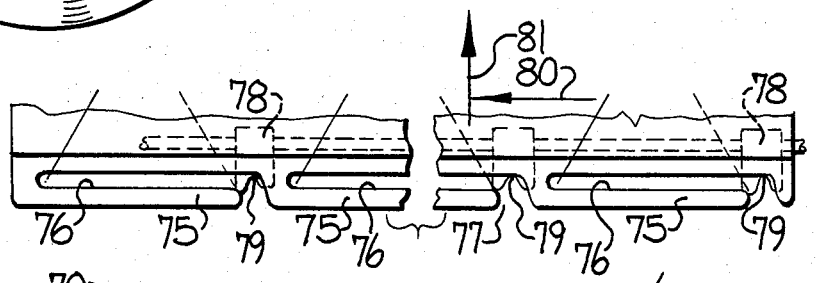
FIG. 6 is a top plan view of the protective cover plate and taken in the direction of Arrow VI in FIG. 5.

FIGS. 5 and 6 illustrate an embodiment of a housing for the traversing assemblies shown in FIG. 5. As shown in these figures, each traversing assembly is covered by a protective cover plate 75 which extends along the front of the machine. This protective plate 75 covers the planes of rotation I and II and extends downwardly in the direction of the yarn path. This arrangement prevents the operator from coming into contact with the rotating arms, and in addition, from getting a yarn suction pistol or the like into the circles of rotation of the arms when inserting the yarn, and which could otherwise damage the arms and change their phase relationships. Each protective plate includes a yarn guide slot 76 which is vertically aligned with the guide bar 9, note FIG. 5. The slot 76 is closed at one end, but includes a yarn inserting opening 77 at the other end and so as to communicate with the guide notch 79 of the transfer means 78 which is adapted to form the transfer tail. After a yarn has been inserted into the transfer means 78, the transfer means 78 slowly moves to the center of the traverse stroke in the direction indicated by the arrow 80, and in doing so, a transfer tail consisting of several yarn windings is formed on the bobbin outside the normal zone of the traverse stroke. The transfer means 78 then withdraws from the yarn path in the direction of arrow 81, and as a result, the released yarn moves toward the center of the traverse stroke. During this movement, the yarn is caught by the oppositely rotating rotors 5 and 6.

Figure 7:
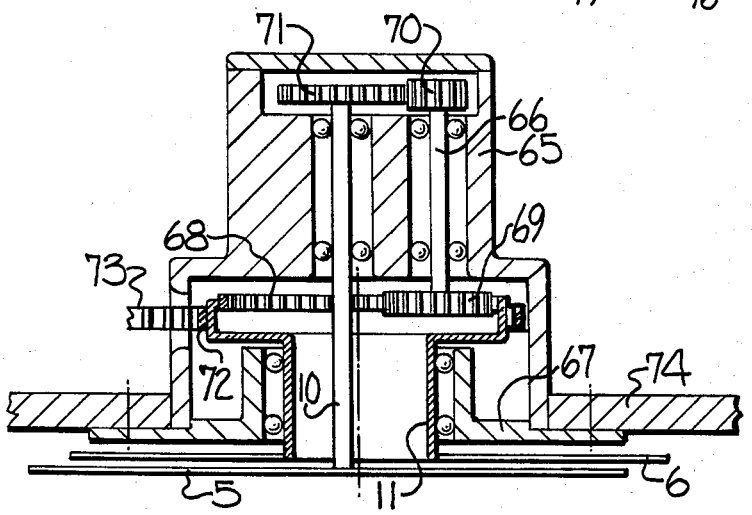
FIG. 7 is a sectional elevation view of a casing for mounting a pair of rotors of a traversing assembly.

In the embodiment of FIG. 7, there is provided a casing 65 for the shafts 10 and 11, and which in plan view has an oval shape, with the primary axis extending in the direction of eccentricity e between the shaft 10 and the shaft 11. The shaft 10 for the rotor 5 is rotatably mounted in the casing 65, and the casing cover 67 rotatably mounts the tubular shaft 11 of the rotor 6. During assembly of the casing, the cover 67 and casing 65 are fixedly connected to each other by bolts or the like (not shown). The tubular shaft 11 is provided with internal gear 68, and the outside surface of the shaft 11 includes an external gear 72 for engagement with a toothed wheel or toothed belt 73. The casing 65 is provided with appropriate recesses to permit the belt 73 to pass therethrough. By this arrangement, rotational movement is imparted to the tubular shaft 11 by the belt 73, and is transmitted to the shaft 10, via the transmission shaft 66, which is also rotatably mounted in the casing 65. More particularly, the transmission shaft 66 includes a gear 69 operatively engaging the internal gear 68 of the shaft 11, and a gear 70 cooperating with the mating gear 71 on the shaft 10. By providing for the proper engagement of the gears during assembly of the casing, the casing may be preassembled such that the phase relationship of the rotors 5 and 6 is set in such a manner that an exact transfer of the yarn at the stroke reversal points is ensured. The preassembled casing 65 may be installed in the machine frame 74, which comprises a part of the housing of the traversing assemblies. After assembling the casing 65 to the frame 74, the phase relationship of the rotors of adjacent assemblies may be set in accordance with the present invention, by interconnecting the external gear 72 with the associated gear or belt 73.

Figures 8, 9, 10:
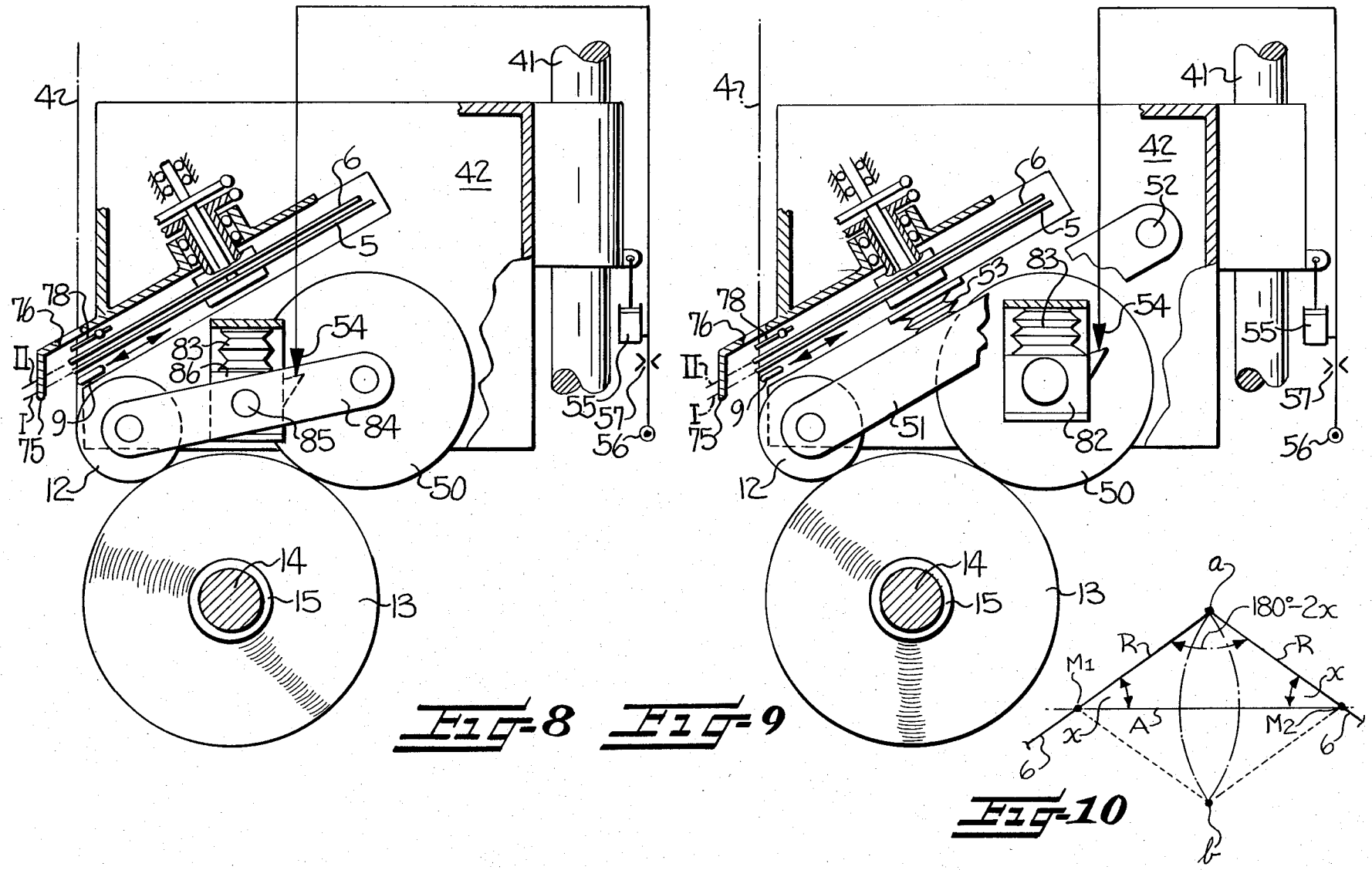
FIGS. 8 and 9 are end sectional views similar to FIG. 2 but illustrating further embodiments of the invention.
FIG. 10 is a schematic representation of the phase and angular relationships of two adjacent rotors.

FIGS. 8 and 9 illustrate embodiments which are generally similar to the embodiment of FIG. 5. However, these embodiments comprise a drive roll 50 which is movable with respect to the mounting carriage 42. For this purpose, a bearing body 82 is slideably mounted to the carriage 42 by an arrangement which includes the disc springs 83. The nozzle 54 of the nozzle and deflecting plate system is fixed to the carriage, and the nozzle monitors the movements performed by the body 82 with respect to the carriage 42. The pressure prevailing in the cylinder and piston unit 55 is thereby controlled such that as the diameter of the package builds, the distance between the nozzle and the deflecting plate is reduced and the pressure in the supporting system thus becomes increased. The increased pressure causes the carriage 42 to move upwardly until a balance of pressure is re-established.

Referring again to FIG. 8, the guide rolls 12 and drive rolls 50 are mounted on a common pivoting support 84. The support 84 pivots about the pin 85, and the axis of the pin 85 is mounted in a bearing body 86 which is able to move in a guide way relative to the carriage and against the disc springs 83. The relative movement performed by the bearing body 86 in turn is monitored by the nozzle and deflecting plate system 54 and transmitted to the cylinder and piston unit 55 as described above.

In all of the above described embodiments of the present invention, it will be noted that the outer extremity of each arm of each rotor includes a leading edge 90 (note FIG. 1) facing in the direction of its rotation and which is adapted to contact and move the running yarn toward the end of the traverse stroke, and a trailing edge 91 which extends from the outermost tip of the arm and is slightly convexly curved along its length. The curvature of the trailing edge 91 is configured to cooperate with the guide bar 9 in engaging the yarn after the yarn has reached the end of the traverse stroke and so as to permit the yarn to move along the trailing edge and guide bar from the end of the traverse stroke toward the center thereof at a controlled speed. A further description of this feature of the invention is described in the copending application of Herbert Turk, Ser. No. 445,285.

FIG. 10 schematically illustrates certain relationships whenever two or more rotors are positioned in the same plane and spaced apart a distance A. As illustrated, the two adjacent rotors 6 rotate in the same direction about the axes M1 and M2, which are spaced apart the distance A, and each has a diameter of two times the length R of the arms, and $2R > A$ so that the circles of rotation overlap. Also, there are two points of intersection of the two circles, namely a and b. Two isosceles triangles are thus formed between the points a and b, with the base A being common, and the sides R being equal. Also, the angles x of the triangles are equal, and the relationship may be given:

$$\cos x = \frac{A}{2R} \text{ or } x = \arccos \frac{A}{2R}.$$

For rotor arms rotating in the same direction, no collision will occur if the following relationship is present:

$$180° - 2x > y > 2x, \text{ or}$$

$$180° - 2 \arccos \frac{A}{2R} > y > 2 \arccos \frac{A}{2R},$$

where y is the phase shift, defined as the angle between the two adjacent rotor arms (which is substantially 90° in the embodiment of FIG. 1).

A collision of the two arms takes place, which of course must be avoided, if the following phase relationship occurs:

$$2x > y > 180° - 2x, \text{ or}$$

$$2 \text{ arc cos } \frac{A}{2R} > y > 180° - 2 \text{ arc cos } \frac{A}{2R}.$$

From the above, it will be seen that the angle x makes sense within the limits $$45° > x > 0°.$$

Where x=0 (and A=2R), the circles do not intersect but merely touch each other. Where x=45° (and $A=R\sqrt{2}$), there is defined the closest distance between the centers of rotation, it being understood that this represents an ideal value for a rotor arm having zero width. Thus the corresponding axes of the adjacent traversing assemblies should be spaced apart a distance A which is less than twice the radial length R of the arms and greater than the radial length times the square root of two.

In the drawings and specification, there has been set forth a preferred embodiment of the invention, and although specific terms are employed, they are used in a generic and descriptive sense only and not for purposes of limitation.

That which is claimed is:

1. A winding apparatus for winding a plurality of running yarns to form a corresponding number of yarn packages, and comprising bobbin support means for mounting a plurality of tubular bobbins in a coaxial arrangement, and yarn traverse means for reciprocating the running yarns along respective aligned traverse strokes and so as to form a wound yarn package on each bobbin, the improvement wherein said yarn traverse means comprises a plurality of traversing assemblies disposed in a closely spaced apart arrangement extending along said bobbin support means so as to permit the bobbins to be disposed closely adjacent to each other on said support means, with each traversing assembly being adapted to reciprocate a running yarn onto a rotating bobbin mounted on said support means, and with each traversing assembly comprising (a) a yarn guide bar mounted to extend in a direction generally parallel to the axis of said support means, (b) a first rotor having two oppositely directed radial arms of equal length, and with said rotor being mounted for rotation about a first axis such that the extremities of the rotating arms pass along said yarn guide bar and define a first plane, (c) a second rotor having two oppositely directed radial arms of equal length and which generally correspond to the length of said arms of said first rotor, and with said second rotor being mounted for rotation about a second axis such that the extremities of the rotating arms pass along said yarn guide bar and define a second plane, and with said first axis being parallel to and offset from said second axis in a direction generally parallel to the axis of said support means, and with the first and second planes being parallel to and closely adjacent each other, said traversing assemblies being mounted adjacent to each other such that each traversing assembly has its first axis offset from its second axis in the same direction and with the corresponding axes of all of the adjacent traversing assemblies being equally spaced apart a distance which is less than twice the radial length of the arms and greater than the radial length of the arms times the square root of two, and such that said first and second planes of said assemblies are respectively coincident, and further such that the extremities of the arms of adjacent traversing assemblies define circles upon rotation thereof which overlap in both of said first and second planes, and drive means for rotating the rotors of each traversing assembly in opposite directions with respect to each other, and for rotating the rotors of adjacent traversing assemblies such that the first rotors thereof rotate in the same direction with respect to each other and the second rotors thereof rotate in the same direction with respect to each other.

2. The winding apparatus as defined in claim 1 wherein each of said traversing assemblies further comprises a guide roll mounted for rotation about an axis parallel to the axis of said bobbin support means and at a location between said guide bar and said bobbin support means, and such that a running yarn is adapted to partially loop about said guide roll prior to being wound onto a bobbin.

3. The winding apparatus as defined in claim 2 wherein said guide rolls of all of said traversing assemblies are disposed coaxially to each other.

4. The winding apparatus as defined in claim 1 wherein the outer extremity of each of said arms of each rotor includes a leading edge facing in the direction of its rotation and which is adapted to contact and move the running yarn toward one end of the traverse stroke, and a trailing edge configured to cooperate with said yarn guide bar in engaging the yarn after the yarn has reached said one end of the traverse stroke and so as to permit the yarn to move along the trailing edge and guide bar from said one end of the traverse stroke toward the center thereof at a controlled speed.

5. The winding apparatus as defined in claim 1 wherein said first and second rotors of each traversing assembly are disposed on one side of the yarn traverse stroke, and said yarn guide bar of each traversing assembly is disposed on the same side of the yarn traverse stroke.

6. The winding apparatus as defined in claim 5 further comprising means mounting said yarn guide bar to permit withdrawal thereof in a direction extending away from said rotor axes.

7. The yarn winding apparatus as defined in claim 1 wherein said yarn guide bar of each traversing assembly includes a yarn catching notch at at least one of the ends thereof.

8. The yarn winding apparatus as defined in claim 1 wherein said yarn guide bar of each traversing assembly includes parallel, spaced apart rails along each end portion thereof to thereby provide opposing yarn guide edges along each end portion.

9. The winding apparatus as defined in claim 1 wherein the reciprocating running yarns define a running plane, and wherein said first and second planes of said traversing assemblies are disposed at an angle between about 45 degrees to 70 degrees with respect to said running plane.

10. The winding apparatus as defined in claim 1 wherein said first rotor of each traversing assembly includes a first shaft extending along said first axis, and said second rotor of each traversing assembly includes a second shaft extending coaxially along said second axis.

11. The winding apparatus as defined in claim 10 wherein said second shaft is tubular, and said first shaft extends eccentrically therethrough.

12. The winding apparatus as defined in claim 11 wherein said first and second shafts of each of said traversing assemblies are disposed on the side of the first and second planes of rotation which is adjacent said support means.

13. The winding apparatus as defined in claim 12 wherein said drive means includes gear means operatively engaging the exterior surface of said tubular second shaft, and transmission means interconnecting said tubular second shaft with said first shaft so that the two shafts rotate at the same speed but in opposite directions.

14. The winding apparatus as defined in claim 13 wherein said first shaft, said tubular second shaft, and said transmission means of each traversing assembly are all mounted in a common casing, with said casing having an opening communicating with said tubular second shaft for permitting operative passage of said gear means.

15. The winding apparatus as defined in claim 10 wherein said first and second shafts of each of said traversing assemblies are disposed on opposite sides of said planes of rotation.

16. The winding apparatus as defined in claim 15 further comprising a first housing component rotatably supporting said first shaft, a second housing component rotatably supporting said second shaft, and hinge means pivotally interconnecting said first and second housing components so as to permit the separation thereof.

17. The winding apparatus as defined in claim 1 wherein said drive means comprises a first drive rod extending along the length of said traversing assemblies and operatively engaging each of said first rotors, and a second drive rod extending along the length of said traversing assemblies and operatively engaging each of said second rotors.

18. The winding apparatus as defined in claim 17 wherein said drive means further comprises a worm gear wheel coaxially mounted to each of said first and second shafts of each of said traversing assemblies, a plurality of worms mounted on said first drive rod and operatively engaging respective worm gear wheels of said first shafts, a plurality of worms mounted on said second drive rod and operatively engaging respective worm gear wheels of said second shafts, and with the worms of each rod having the same thread direction.

19. The winding apparatus as defined in claim 1 further comprising a protective cover plate positioned to overlie said yarn guide bar of each traversing assembly, with said cover plate including a slot generally aligned with said guide bar in the direction of the running yarn for receiving the yarn therethrough.

20. The winding apparatus as defined in claim 19 further comprising means disposed immediately adjacent said slot in said cover plate for forming a transfer tail on the associated wound yarn package.

21. The winding apparatus as defined in claim 1 further comprising drive roll means adapted to contact the surface of each of the yarn packages being wound on said bobbin support means.

22. The winding apparatus as defined in claim 1 wherein the arms of the rotors of adjacent traversing assemblies which lie in the same plane have an angular phase shift of substantially 90°.

* * * * *